US008706012B2

(12) United States Patent
Priebe et al.

(10) Patent No.: US 8,706,012 B2
(45) Date of Patent: Apr. 22, 2014

(54) ANNULAR INTERMEDIATE TRANSFER MEMBERS, APPARATUS, AND USE

(75) Inventors: Alan R. Priebe, Rochester, NY (US); Jerry A. Pickering, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 56 days.

(21) Appl. No.: 13/541,784

(22) Filed: Jul. 5, 2012

(65) Prior Publication Data

US 2013/0011169 A1 Jan. 10, 2013

Related U.S. Application Data

(60) Provisional application No. 61/505,281, filed on Jul. 7, 2011.

(51) Int. Cl.
*G03G 15/01* (2006.01)

(52) U.S. Cl.
USPC ..... 399/302; 399/308

(58) Field of Classification Search
USPC ..... 399/121, 302, 308
See application file for complete search history.

(56) References Cited

U.S. PATENT DOCUMENTS

| | | | | |
|---|---|---|---|---|
| 5,298,956 | A | 3/1994 | Mammino et al. | |
| 5,828,931 | A | 10/1998 | May et al. | |
| 5,968,656 | A | 10/1999 | Ezenyilimba et al. | |
| 6,377,772 | B1 * | 4/2002 | Chowdry et al. | 399/302 |
| 6,456,816 | B1 * | 9/2002 | Chowdry et al. | 399/302 |
| 7,214,757 | B2 | 5/2007 | Gloyer et al. | |

* cited by examiner

*Primary Examiner* — Hoang Ngo
(74) *Attorney, Agent, or Firm* — J. Lanny Tucker

(57) ABSTRACT

An annular intermediate transfer member can be used to transfer toner particles. This annular intermediate transfer member comprises an innermost non-metallic core, a cushioning layer, and an outermost toner-carrying layer. The innermost non-metallic core has 1) a mounting force of equal to or less than 15 $lb_f$, 2) a radial resistance of up to and including 50,000 ohm of the innermost non-metallic core thickness, and 3) a surface resistance of up to and including 17,000 ohm. The annular intermediate transfer member can be incorporated into various apparatus that are used to provide toner images and used in methods for providing black-and-white and color toned images on various substrates.

20 Claims, 1 Drawing Sheet

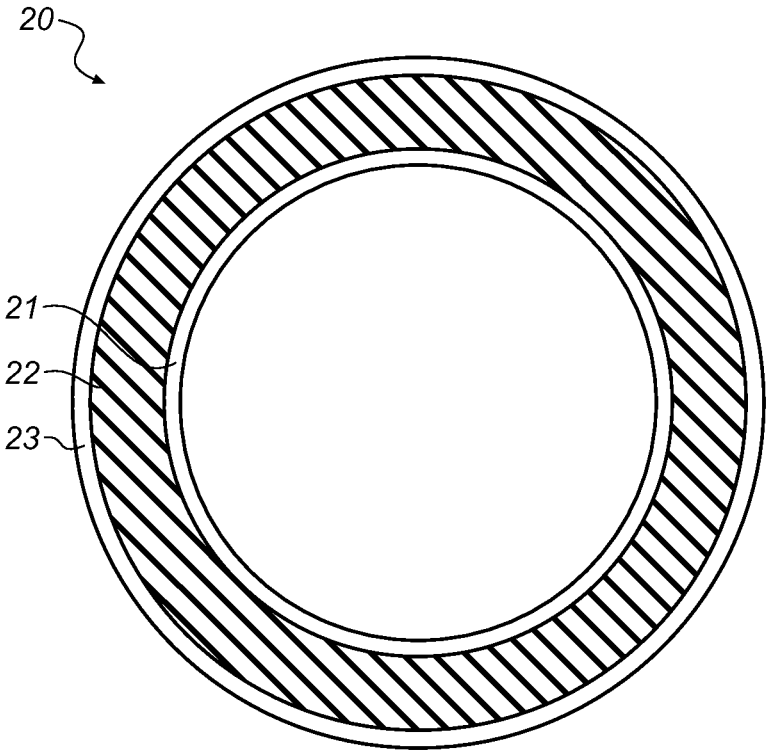
20
21
22
23

ANNULAR INTERMEDIATE TRANSFER MEMBERS, APPARATUS, AND USE

This application claims the benefit of U.S. Provisional Patent Application No. 61/505,281 filed Jul. 7, 2011, which is incorporated herein by reference in its entirety.

FIELD OF THE INVENTION

This invention relates to annular intermediate transfer members that can be used in electrophotography to provide toner images on image receiving members. This invention also relates to apparatus containing the annular intermediate transfer members and to methods of providing toned images using the articles or apparatus of this invention.

BACKGROUND OF THE INVENTION

The use of an intermediate transfer member in an electrophotographic (or sometimes known as electrostatographic) machine to transfer toner particles from an imaging member to an image receiving member (for example, a sheet of paper) is well known and is practiced in many commercial electrophotographic copiers and printers.

For example, a toner image is formed on a primary image-forming member (PIFM) such as a photoconductor and is then transferred in a first transfer operation to an intermediate transfer member (ITM) and is subsequently transferred in a second transfer operation from the ITM to an image receiving member. In the second transfer of the toner image, a transfer back-up roller is commonly used behind the image receiving member, and a nip is formed to press the image receiving member to the ITM.

Intermediate transfer members have been designed in various shapes, such as endless belts, webs, sleeves, tubes, drums, and rollers. Many useful rollers comprise an innermost non-metallic core that is generally quite rigid, a cushioning layer (compliant layer), and an outermost toner-carrying layer, for example as described in U.S. Pat. No. 5,828,931 (May et al.).

U.S. Pat. No. 6,377,772 (Chowdry et al.) describes an intermediate transfer member that comprises a cylindrical rigid core member, a compliant inner sleeve member in intimate non-adhesive contact with the cylindrical rigid core member, and a compliant outer sleeve member in intimate non-adhesive contact with the surrounding inner sleeve member. A photoconductive or outermost toner-carrying layer is disposed on the outer sleeve member.

In use, an annular intermediate transfer member is slid onto a cylindrical mandrel in the imaging apparatus and the annular inner core diameter is generally designed to be slightly less than the diameter of the cylindrical mandrel so that a very tight fit is achieved. However, the intermediate transfer member needs to be moved onto and off the mandrel from time to time during normal printing operations.

After a used ITM is removed from a press mandrel, it is replaced with another ITM having acceptable electrical and mechanical properties for more uniform or improved imaging performance. After imaging for many cycles in the printing press, the ITM outer surface can become worn or covered with foreign material, resulting in lessened imaging quality and requiring replacement. To minimize operating cost, it is desirable to reduce the cost of the ITM by reducing raw material costs, especially that of the innermost core. The annular innermost core holds the ITM on the cylindrical mandrel by contact pressure between the cylindrical mandrel and a thin, high-modulus innermost metallic core made to a precise diameter range. The controlled strain results in a tightly controlled level of contact force, while still allowing mounting on the cylindrical mandrel. The required level of precision in size, and the use of nickel with electrical conductivity can increase cost significantly. Such materials are also susceptible to damage in handling and increasing the cost of such materials.

It is desired to have lower cost raw materials that can be fabricated into innermost cores to have a precise annular diameter range, while maintaining that diameter over a long time period through many printing cycles and a normal range of operating environments. For example, it is desired to provide innermost core materials for annular intermediate transfer members that maintain sufficient elasticity so that they can be used through multiple mounting and manufacturing cycles.

SUMMARY OF THE INVENTION

The present invention provides an annular intermediate transfer member for transfer of toner particles, the annular intermediate transfer member comprising:

an innermost non-metallic core, a cushioning layer, and an outermost toner-carrying layer, wherein the innermost non-metallic core has all of the following properties:

1) a mounting force of equal to or less than 15 $lb_f$, 2) a radial resistance of up to and including 50,000 ohms of the innermost non-metallic core thickness, and 3) a surface resistance of up to and including 17,000 ohm.

This invention also provides an apparatus for forming toner images, the apparatus comprising:

1) at least one image-forming device for forming a toner image on a toner receiving element, 2) a transfer system for transferring the toner image from the receiving member to an annular intermediate transfer member that is any of the embodiments of this invention, to form an image on the outermost toner-carrying layer of the annular intermediate transfer member, and 3) a second transfer system for transferring the image formed on the toner-carrying layer of the annular intermediate transfer member onto an image receiving material.

Further, this invention provides a method for providing a toned image on an image receiving member, the method comprising:

forming a toner image corresponding to a predetermined image on a toner receiving element, transferring the toner image from the toner receiving element to the outermost toner-carrying layer of an annular intermediate transfer member of any of the embodiments of this invention, and transferring the toner image from the toner-carrying layer of the annular intermediate transfer member onto an image receiving material.

In some embodiments of the method of this invention:

the innermost non-metallic core comprises: (1) a homogeneous blend of two or more resin binders, at least one of which is an unsaturated polyester, (s) a uniform blend of one or more resin binders and a reinforcing material selected from the group consisting of glass fibers, inorganic fillers, polymeric fillers, polymeric fibers, and mixtures thereof, and (3) a uniform blend of one or more resin binders and at least one conductive material selected from the group consisting of conductive polymers, conductive inorganic fillers, carbon/graphic fillers, conductive metal particles, conductive bonding agents on glass fibers, and mixtures thereof, the innermost non-metallic core has an average dry thickness of at least 0.1 mm and up to and including 3 mm, the innermost non-metallic core has elasticity so that, when a pressurized fluid is forced along the inner surface of the innermost non-metallic core, the innermost non-metallic core can be moved relative to a rigid cylindrical member that it surrounds, which rigid cylindrical member has an outer diameter that is greater than the inner diameter of the innermost non-metallic core such that the innermost non-metallic core cannot be moved relative to the rigid cylindrical member without the pressurized fluid, and the annular intermediate transfer member has an average dry thickness of at least 0.3 mm and up to and including 4 mm.

The annular intermediate transfer member can be provided in a rigid, semi-rigid, or flexible form or as a web or belt, for use in various electrostatographic or electrophotographic apparatus and processes.

The present invention provides following advantages. For example, using an innermost non-metallic core for the annular intermediate transfer member reduces the cost. This invention results in less damage to this innermost non-metallic core during shipping and handling, because it is more durable and tougher than thin metal cores known in the art. The present invention also improves the ability to use the annular intermediate transfer member through multiple cycles of manufacturing and re-mounting, since the innermost non-metallic core maintains sufficient elasticity within a desirable range over a long period of operation.

Yet another advantage of this invention is the improved adhesion of the elastomeric cushioning layer to the innermost non-metallic core, such that it is unnecessary to apply a separate primer layer as may be necessary to bond the elastomeric cushioning layer to many known metal cores, thereby reducing manufacturing costs further.

BRIEF DESCRIPTION OF THE DRAWINGS

FIG. 1 is a cross-sectional view of an embodiment of an annular intermediate transfer member of this invention.

DETAILED DESCRIPTION OF THE INVENTION

Definitions

As used herein to define various materials and layers of the annular intermediate transfer member, unless otherwise indicated, the singular forms "a", "an", and "the" are intended to include one or more of the components (that is, including plurality referents).

Each term that is not explicitly defined in the present application is to be understood to have a meaning that is commonly accepted by those skilled in the art. If the construction of a term would render it meaningless or essentially meaningless in its context, the term's definition should be taken from a standard dictionary.

The use of numerical values in the various ranges specified herein, unless otherwise expressly indicated otherwise, are considered to be approximations as though the minimum and maximum values within the stated ranges were both preceded by the word "about". In this manner, slight variations above and below the stated ranges can be used to achieve substantially the same results as the values within the ranges. In addition, the disclosure of these ranges is intended as a continuous range including every value between the minimum and maximum values.

Because the apparatus in which an annular intermediate transfer member (ITM) can be used, are generally known from considerably literature, including U.S. Pat. No. 6,377,772 (noted above) that is incorporated by reference, the present description will be directed in particular to subject matter forming part of, or cooperating more directly with, the present invention.

The present invention relates to an article useful in electrostatographic imaging, including electrographic recording using a stylus or other electrographic writer, and to electrophotographic recording using modulated light either through optical recording apparatus or electro-optical recording using LED's, lasers, and other known light modulating devices using for example mirrors or displays. The present invention is particularly suited to electrophotographic black-and-white or full color imaging utilizing one or more transferable single-color toner images, whereby each single-color toner image can be formed on a toner receiving element (described below), for example using a double-sleeved roller or photoconductor, transferring each single-color toner image in a first transfer step from the toner receiving element to an annular intermediate transfer member of the present invention, and subsequently transferring in a second transfer step each single-color toner image from the annular intermediate transfer member onto a suitable image receiving material (described below).

For example, the method of this invention can be used for forming a color image by sequentially forming color toner images on the toner receiving element and sequentially transferring the color toner images from the toner receiving element to two or more annular intermediate transfer members of this invention, and then transferring the sequential color toner images from the two or more annular intermediate transfer members to an image receiving material in superimposed registration. In some embodiments, full color toner images can be formed from four or more (for example at least cyan, yellow, magenta, and black) color toner images that are provided on the image receiving material in superimposed registration. It is also possible to use the present invention to provide pearlescent, metallic, or fluorescent toner images, with or without non-fluorescent color toner images, for example as described in U.S. Pat. No. 5,910,388 (Ray et al.), U.S. Pat. No. 7,326,507 (Schulze-Haganest et al.), and U.S. Pat. No. 7,955,772 (Schuster et al.) and U.S. Patent Application Publication 2010/0164218 (Schulze-Hagenest et al.), 2011/0160389 (Bubat et al.), 2011/0262654 (Yates et al.), and 2011/0262858 (Nair et al.), all of which are incorporated herein by reference.

Alternatively, a double-sleeved annular intermediate transfer member can serve bifunctionally as both a transfer element and as an image receiving material. That is, the annular intermediate transfer member can be made photoconductive so that a transferred first toner image formed on the toner receiving element can be transferred in registry on top of a second toner image independently formed on the photoconductive intermediate transfer member, thereby creating a composite two-color toner image on the annular intermediate transfer member, which can be subsequently transferred to a transfer element in the form of a receiver member.

In another alternative, the present invention can be used in electrographic recording of each primary color image using stylus recorders or other known recording methods for recording a toner image on a toner receiving element that can comprise a dielectric sleeve member. The toner image can be transferred as described herein. The primary image can be formed using a belt as the toner receiving element when a double-sleeved annular intermediate transfer member (drum) is used.

The present invention can be used to form single-color or full color toner images. Toner particles are well known in the art and are not described in detail in this description, but a skilled worker in the art would know how to make or acquire suitable color, colorless, fluorescent, and metallic toner particles. In generally, most useful toner particles are relatively small, for example at least 2 μm and up to and including 30 μm in mean volume weighted diameter as measured using conventional diameter measuring devices such as a Coulter Multisizer (available from Coulter, Inc.). Mean volume weight diameter refers to the sum of the mass of each toner particle times the diameter of a spherical particle of equal mass and density, divided by the total particle mass. Toner particles can be composed of desired polymeric materials and further comprise suitable dyes or pigments for a desired color or effect (such as metallic or pearlescent effect) and surface additives such as small fumed silica, alumina, or titania particles to improve toner particle transfer in the process of making toner images.

Annular Intermediate Transfer Member (ITM)

As noted above, the annular ITM of this invention comprises an innermost non-metallic core, a cushioning layer, and an outermost toner-carrying layer. In most embodiments, the annular ITM is a rigid structure such as in a rigid cylindrical form (like a sleeve) so it can be slid onto a cylindrical mandrel or roller in an imaging apparatus such as an electrophotographic printer.

The cylindrical embodiments can be rigid or have some flexibility while the annular ITM substantially maintains its cylindrical shape even when up to 0.1 Newtons/$cm^2$ is applied to the outer surface of the outermost toner-carrying layer. The following discussion will focus primarily on such rigid cylindrical embodiments but it is contemplated that the present invention also includes semi-rigid or flexible annular intermediate transfer members that have some flexibility so that their annular shape can be deformed to a certain degree.

For example, in some embodiments, the annular intermediate transfer member has a flexible structure sufficient to reduce the smallest diameter to as little as 20% (or typically to as little as 50%) of the original diameter of the annular intermediate transfer member when it is in a non-flexed state.

The annular intermediate transfer member of this invention generally has an average dry thickness of at least 0.4 mm and up to and including 5 mm, and typically up to and including 4 mm.

In many embodiments, the annular intermediate transfer member has a seamless outer surface.

Innermost Non-Metallic Core:

The innermost non-metallic core embodiments have certain properties:

1) a mounting force of equal to or less than 15 $lb_f$ (67 Newtons) or typically at least 2 $lb_f$ (9 Newtons) and up to and including 15 $lb_f$ (67 Newtons), 2) a radial resistance of up to and including 50,000 ohm of the innermost non-metallic core thickness, or typically at least 100 ohm and up to and including 50,000 ohm of the innermost non-metallic core thickness, and 3) a surface resistance of up to and including 17,000 ohm, or typically at least 100 ohm and up to and including 17,000 ohm.

The mounting force of the innermost non-metallic core can be measured using the procedure described below before the Examples. If the mounting force greater than 15 $lb_f$ (Newtons), the problem is that a person using the annular ITM can become too fatigued while removing and replacing one or more of them on a mandrel. If it is too low, for example, less than 2 $lb_f$ (9 Newtons), the problem is that either the innermost non-metallic core tensile modulus is too low, the diametrical friction between the innermost non-metallic core and a mandrel is too low, or a combination of such conditions, such that there is insufficient friction and contact pressure between the annular ITM and an inner mandrel to hold the annular ITM in a fixed relationship to the inner mandrel during the imaging processes, which can result in objectionable image defects, such as image smears or poor color-to-color registration. Thus, for the advantages of this invention, it is important to keep the mounting force within the noted amounts. This is done by using the materials described below to construct the innermost non-metallic core.

The radial resistance of the innermost non-metallic core can be measured as described below before the Examples. If the resistance is higher than 50,000 ohms, the problem is that insufficient electrical current will flow from the inner mandrel to the outermost toner-carrying layer of the annular ITM during imaging processes to effectively transfer a toner image from an imaging cylinder to the annular ITM, and from the annular ITM to an image receiver. If the radial resistance is too low, for example, below 100 ohms per mm, the problem is that the innermost non-metallic core would require such a high concentration of conductive agent that the cost of the annular ITM would be prohibitive, or the innermost non-metallic core would be too brittle for use.

The surface resistance of the innermost non-metallic core can be measured as described below before the Examples. If the resistance is greater than 17,000 ohm, the problem is that insufficient electrical current would flow from the front to the rear of the annular ITM, creating a voltage drop between front and rear of the innermost non-metallic core, which would further lead to insufficient current flow from the innermost non-metallic core to the outermost toner-carrying layer of the annular ITM during the imaging processes to effectively transfer a toner image from an imaging cylinder to the annular ITM, and from the annular ITM to an image receiver. If it is too low, for example, below 100 ohm, the problem is that the innermost non-metallic core would need such a high concentration of conductive agent that either the cost of the annular ITM would be prohibitive, or the innermost non-metallic core material would become too brittle for use.

The innermost non-metallic core can comprise one or more resin binders, at least one of which is an unsaturated polyester. For example, the innermost non-metallic core can comprise a homogeneous blend of two or more resin binders, at least one of which is an unsaturated polymer such as an unsaturated polyester. The one or more resin binders can be present in an amount of at least 10 weight % and up to and including 95 weight %, based on total solids in the innermost non-metallic core. In the blend of two or more resins, the weight ratio of unsaturated polymer or unsaturated polyester to the other resins is at least 1:10 and up to and including 10:1.

In addition, the innermost non-metallic core can comprise a uniform blend of one or more resin binders and a reinforcing material selected from the group consisting of glass fibers, inorganic fillers, polymeric fillers, polymeric fibers, and mixtures thereof. Such reinforcing materials can be present in an amount of at least 1 weight % and up to and including 80 weight %, based on total solids in the innermost non-metallic core.

Alternatively, the innermost non-metallic core can comprise a uniform blend of one or more resin binders and at least one conductive material selected from the group consisting of conductive polymers, conductive inorganic fillers, carbon/graphic fillers, conductive metal particles, conductive bonding agents on glass fibers, and mixtures thereof. For example, the conductive material can be a non-moisture absorbing material. Such conductive materials can be present in an amount of at least 1 weight % and up to and including 20 weight %, based on total solids in the innermost non-metallic core.

The innermost non-metallic core generally has an average dry thickness of at least 0.1 mm and up to and including 3 mm, or typically an average dry thickness of at least 0.4 mm and up to and including 2 mm. This average dry thickness can be taken as the average of at least 10 different measurements.

While the innermost cylindrical or web non-metallic core can be a single layer or stratum, it can also be multiple strata to provide a cumulative average dry thickness of all strata of at least 0.1 mm and up to and including 3 mm.

The innermost non-metallic core can be directly adhered to the cushioning layer (described below) using an adhesive such as Loctite® 7649™ Primer, or it can be adhered with an intermediate subbing or primer layer. Suitable subbing layer materials include but are not limited to, a polyurethane mixed with a conductive agent. If present, the intermediate subbing or primer layer can have a dry thickness of at least 0.0001 mm and up to and including 0.001 mm.

The innermost non-metallic core can be designed to have an elasticity so that, when a pressurized fluid is forced along the inner surface of the innermost non-metallic core, the innermost non-metallic core can be moved relative to a rigid cylindrical member (for example, a roller or mandrel) that it surrounds, which rigid cylindrical member has an outer diameter that is greater than the inner diameter of the innermost non-metallic core such that the innermost non-metallic core cannot be moved relative to the rigid cylindrical member without the pressurized fluid.

For example, the innermost non-metallic core can be composed of various materials or composites. For example, it can be composed of epoxy resins (for example as described in http://epoxy.dow.com/epoxy/-products/app/comp.htm). Such materials are generally a reaction product of Epichlorohydrin/bisphenol A (for example, D.E.R.™ 331 Liquid Epoxy Resin) or Epichlorohydrin/bisphenol F (D.E.R.™ 354 Liquid Epoxy Resin), or mixtures of both products (Dow Chemical Company), or a Bisphenol A diglycidylether (D.E.R.™ 332 Epoxy Resin, Dow Chemical Company).

Curing agents (hardeners) can be used to prepare such compositions. Most frequently used curing agents are cycloaliphatic polyamines, polyamides, amidoamines, and modified versions of these (Dow Chemical Company) to produce a reaction product of epichlorohydrin and phenol-formaldehyde novolac (D.E.N.™ 425 Epoxy Novolac Resin, Dow Chemical Company).

Useful innermost non-metallic core materials can also include styrenic resins that are used as blending materials, polyurethane resins (BASF materials), unsaturated polyester resins such as orthophthalic-based resins (DSM Putty resins), isophthalic-based resins (for example, DSM Synolite 0025-N-1), cured with MEKP/Co curative, dicyclopentadiene-based resins (DSM Putty resins, for example, Synolite 0175-N-7), tetrahydrophthalic anhydride resins (DSM Putty resins, for example, Synolite 0175-N-7), cured with BPO, vinyl ester unsaturated polyesters such as propoxylated bisphenol A reacted with fumaric acid (DSM "Atlac" 382 and 4010 resin used by being dissolved in styrene, Atlac 590, a polymer with epoxy novolac backbone used instead of a conventional epoxy bisphenol A, which provide better solvent resistance and higher heat deflection temp, and Epoxy bisphenol A vinyl ester urethanes.

The innermost cylindrical or web non-metallic core can also be prepared from a blend of styrene (Synolite resins, DSM Composite Resins AG), catalyzed with benzoyl peroxide (BPO), for example, 2 weight % BPO-50% Lucidol CH50L (from AKZO Nobel).

Some thermoplastics can be used but they are less preferred than other polymers.

The innermost cylindrical or web non-metallic core also generally includes some reinforcing materials such as reinforcement fibers that can be composed of E-glass, S-glass, carbon (inherently electrically conductive), polyimide, etherimide, poly-paraphenylene terephthalamide (Kevlar), and metal fibers (inherently electrically conductive). Such fibers can be surface treated with sizing agents, and can be arranged in proper orientation for physical properties and electrical conductivity.

Conductive agents can be incorporated especially when non-inherently conductive fiber reinforcement are used, to achieve synergistic conductive effect at lower weight % with less degradation of mechanical strength properties of modulus, tensile strength, and creep). Such conductive agents can include carbon fibers (PAN-based), chopped fiber flake form (for example, Zoltek milled fiber PANEX® 35 in 3 mm typical length), carbon fibers (PAN-based), unsized chopped fiber flake form (for example, Zoltec PANEX® 35" unsized 3-50 mm), carbon fibers (PAN-based), milled fiber (for example, Zoltek Panex® 30 MF/ME 100-150 μm or PANEX® 35 100 μm length), carbon fiber bundles (for example, PANEX® 35 50K Continuous Tow Carbon Fiber), carbon fiber fabrics (for example, PANEX® 35 Stitch-Bonded Uni-Directional Carbon Fabrics, or woven form, PANEX® 35 Woven Fabric).

Also useful are carbon blacks singly or in combination (for example, Ensaco® conductive carbon blacks, conductive metal particles (for example, tin, aluminum, steel, copper, silver, alloys, and nano fiber silver), conductive metal oxides (tin oxide), composite coated particles (for example, conductive ITO-coated $TiO_2$, and silver-coated powders). The orientation of high aspect-ratio particles or fibers is important for electrical conductivity primarily, as well as some level of effect on physical properties Other additives that can be present in the innermost non-metallic core, including inner surface slip or mold release agents to facilitate removal from a casting mandrel, catalysts to increase reactivity at low or high temperature on the casting mandrel, and flow aids to improve resin flow by decreasing viscosity, or to improve wetting of reinforcement fibers, or decreasing surface tension during initial wetting of the fibers with resin on a casting mandrel.

Cushioning Layer:

The cushioning layer can be compose of one or more polyether-based polyurethane elastomers and one or more charge control agents, and has suitable pre-selected resistivity and durability for electrophotographic imaging according to the present invention. Such elastomers are generally prepared from a mixture of a polyisocyanate prepolymer, a polyether polyol prepolymer, and a hardening mixture. Such reactive components and methods for preparing useful polyether-based polyurethane elastomers are described in U.S. Pat. No. 7,214,757 (Gloyer et al.) that is incorporated herein by reference. This patent also describes ways that the polyether-based polyurethane elastomers can be incorporated into various shaped articles including the annular intermediate transfer members of this invention.

In general, the cushioning layer provided in the annular intermediate transfer members has an average dry thickness of at least 1 mm and up to and including 11 mm. The cushioning layer is generally uniform throughout its composition.

Outermost Toner-Carrying Layer:

The outermost toner-carrying layer can be composed of a "ceramer" that is a word formed by merging the words "ceramic" and "polymers". In general, a ceramer comprises a polyurethane silicate hybrid organic-inorganic network. Such materials are known in the art and are described for example, in U.S. Pat. No. 5,968,656 (Ezenyilimba et al.) that is incorporated herein by reference for such materials and details as to how they are prepared.

The outermost toner-carrying layer can have an average dry thickness of at least 0.003 mm and up to and including 0.01 mm.

A representative annular intermediate transfer member of this invention is illustrated in FIG. 1 in which annular intermediate transfer member 20 comprises innermost non-metallic core 21, cushioning layer 22, and outermost toner-carrying layer 23.

The annular intermediate transfer member of this invention can be used in any of the apparatus that are known in the art for providing electrostatographic images such as electrophotographic toner images. For example, a representative apparatus of this invention would be like that described in FIG. 10 of U.S. Pat. No. 6,377,772 (noted above) that is incorporated herein by reference, which is modified with one or more annular intermediate transfer members of this invention. In a particularly useful apparatus, the toner receiving element is a photoconductor, or the annular intermediate transfer member is disposed on a rigid cylindrical member that has an outer diameter greater than the inner diameter of the innermost non-metallic core of the annular intermediate transfer member.

Mounting Force Measurement:

The force required to slide an annular ITM onto a cylindrical mandrel, such as used in a Nexpress production digital printer, is an important factor in customer use of the annular ITM. In order to measure the force required, it is required to use either a Nexpress printer, or a fixture holding a cylindrical mandrel and necessary compressed air devices and connections. Once the proper measurements are made, they can be used to assess whether an annular ITM meets the force requirements.

A fixture to measure the annular ITM mounting force contains the following:

1. Support framework structure
2. Nexpress cylindrical mandrel assembly, of nominal outside diameter 174.000 (marked to show middle zone from 4-6 inches, or 10.2-15.2 cm, from front edge)
3. Compressed air connection hose and connection fitting
4. Precision air pressure regulator (calibrated)
5. Precision air flow rate measurement gauge (calibrated)
6. Air flow adjustment needle valve
7. Air pressure connection valve
8. Hand-held digital force measurement gauge (for example, Shimpo model), calibrated
9. T-fitting on force gauge used to push against the annular ITM on two sides.

The fixture is positioned to allow mounting an annular ITM onto the cylindrical mandrel at about operator arm level [about 48 inches (122 cm) from the floor], and is secured so that up to about 20 $lb_f$ (89 Newtons) can be applied laterally without moving the fixture or causing any problems. The door of the image module housing, if present, is opened to allow access to the cylindrical mandrel.

To set up the device, it is necessary to adjust both air pressure and flowrate settings. The air regulator must be adjusted to control static air supply pressure at 6.5+/−0.1 bar (95.6+/−1.5 psig), when the air valve is closed. This is verified by cycling the air valve on and off several times to vent air, to minimize any hysteresis after any setting adjustment. The air flow must be adjusted after turning on the air valve to the cylindrical mandrel with no annular ITM present on it. The needle valve is opened or closed until the precision air flow meter reads 105+/−1 nl/min.

After adjustment of the measurement fixture, the annular ITM to be tested is held in one hand and supported from below with the other hand, and placed onto the nosecone on the front edge of the cylindrical mandrel. The annular ITM must be slid onto the nosecone 5-10 mm initially, with force from both hands, to achieve the initial location condition of annular ITM interference on the cylindrical mandrel (air pressure is not required). The air pressure supply valve should then be turned on to pressurize the cylindrical mandrel, allowing air to flow out of the holes directly behind the nosecone. The annular ITM should be slid onto the cylindrical mandrel to the location four inches (10.2 cm) from the front nosecone to be at the starting position for measurement.

The calibrated force gauge should have the T-fixture attached, consisting of a short push rod with a broad bar, at least seven inches (17.8 cm) wide, attached perpendicularly to form a T-fixture for pushing equally against an annular ITM on both sides. The gauge should be turned on, switched to proper force units ($lb_f$), with peak hold on, and force reading zeroed while the gauge/T-fixture is held horizontally in the orientation for pushing against an annular ITM.

To measure an annular ITM peak sliding force, the force gauge with T-fixture is placed against the annular ITM started on the cylindrical mandrel at about four inches (10.2 cm) from the front edge. Hand pressure against the gauge is gradually increased until the annular ITM slides at a moderate rate (about 1-2 in/sec, 2.54-5.08 cm/sec) across the cylindrical mandrel, until it reaches the end of the middle zone, at about six inches (15.2 cm) from the front. The force gauge is taken away from the annular ITM, and the maximum (peak) force reading is read from the digital display, and recorded. This annular ITM mounting-force measurement is repeated, generally from three to five times, to determine an average value for peak sliding force. The test is run on both ends of each annular ITM.

Innermost Non-metallic Core Resistance Measurement:

The resistance of the innermost non-metallic core of an annular intermediate transfer member (ITM) used in a Nexpress digital production press is an important factor for the proper imaging performance of the annular ITM. In order to measure the innermost non-metallic core resistance, both radially and surface, it is required to use a fixture holding a cylindrical mandrel with necessary compressed air devices and connections, as well as electrical contacts and an electrical resistance test meter. Once the proper measurements are made, they can be used to assess whether an annular ITM meets the resistance requirements.

A fixture to measure an annular ITM innermost non-metallic core resistance includes the following:

1. Support framework structure
2. Nexpress cylindrical mandrel assembly, of nominal outside diameter 174.000 [marked to show middle zone from 4-6 inches (10.2-15.2) from front edge]
3. Compressed air connection hose and connection fitting
4. Precision air pressure regulator (calibrated)
5. Precision air flow rate measurement gauge (calibrated)
6. Air flow adjustment needle valve
7. Air pressure connection valve
8. Hand-held electrical resistance measurement meter (for example, Omega DVM model), calibrated 9. Electrical contacts on spring-loaded supports to contact the annular ITM innermost non-metallic core surface
10. Electrical brush contact to metal cylindrical mandrel assembly The fixture is positioned for convenience for mounting an annular ITM onto the cylindrical mandrel at about operator arm level [about 48 inches (122 cm) from the floor], and is secured so that up to about 20 $lb_f$(89 Newtons) can be applied laterally without moving the fixture or causing any problems. The door of the image module housing, if present, is opened to allow access to the cylindrical mandrel.

To set up the device, it is necessary to adjust both air pressure and flowrate settings, so that an annular ITM innermost non-metallic core can first be mounted on the cylindrical mandrel before resistance testing can begin. The air regulator must be adjusted to control static air supply pressure at 6.5+/−0.1 bar (95.6+/−1.5 psig), when the air valve is closed. This is verified by cycling the air valve on and off several times to vent air, to minimize any hysteresis after any setting adjustment. The air flow must be adjusted after turning on the air valve to the mandrel with no annular ITM mounted on it. The needle valve is opened or closed until the precision air flow meter reads 105+/−1 nl/min.

After adjustment of the measurement fixture, the annular ITM innermost non-metallic core to be tested is held in one gloved hand and supported from below with the other hand, gloved, and placed onto the nosecone on the front edge of the cylindrical mandrel. The annular ITM innermost non-metallic core must be slid onto the nosecone 5-10 mm initially, with force from both hands, to achieve the initial location condition of annular ITM interference on the cylindrical mandrel (air pressure is not required). The air pressure supply valve should then be turned on to pressurize the cylindrical mandrel, allowing air to flow out of the holes directly behind the nosecone. The annular ITM innermost non-metallic core should be slid onto the cylindrical mandrel all the way to the rear end of the cylindrical mandrel, to the fully mounted position, as the starting position for resistance measurement.

It is best to measure the annular ITM innermost non-metallic core resistance in a series of locations around it longitudinally as well down along its length, to ensure good electrical properties along the entire surface.

The annular ITM innermost non-metallic core should be rotated on the cylindrical mandrel to that the proper longitudinal position on the core is measured. For measuring radial resistance, that is normal to the innermost non-metallic core surface or through it, the electrical meter leads should be connected to both the cylindrical mandrel through the brush contact, and also to a proper surface contact probe positioned at each desired location on the outer surface of the annular ITM innermost non-metallic core. This configuration then measures current flow radially from the cylindrical mandrel, outwardly through the thickness of the annular ITM innermost non-metallic core to the surface. A surface contact probe is an assembly of an electrically conductive tip, an electrical connection on the tip for connection of a meter lead, a push rod, and a loading spring to establish the desired amount of contact force between the contact support and the annular ITM innermost non-metallic core surface, with a given amount of spring deflection. The electrically conductive tip can be made of various materials known to those skilled in the art of measuring electrically conductive materials, in terms of the proper area, conductive material, modulus, tensile/compressive strength, surface roughness, and adhesion.

The gauge should be turned on, switched to resistance measurement mode, units of ohms, with auto-ranging on, and, with the meter leads connected to the annular ITM innermost non-metallic core surface contact probe and cylindrical mandrel, resistance reading taken within several seconds after the measurement reading has stabilized. The contact probe can be lifted off the annular ITM innermost non-metallic core surface and allowed to rest again on the core, to repeat measurement in the same location. Radial resistance measurements can be taken in a variety of surface positions. Sets of annular ITM innermost non-metallic core resistance measurements should also be taken twice, that is with the annular ITM innermost non-metallic core mounted with both ends positioned to the front on the cylindrical mandrel, to verify good electrical contact to the innermost non-metallic core is possible on both ends.

Surface Resistance Measurement:

To measure ITM innermost non-metallic core surface resistance, the annular ITM should be mounted on the cylindrical mandrel as before. Meter leads should be connected to two separate surface contact probes. This measures the current flow between two separate points on the annular ITM innermost non-metallic core surface. Pairs of contact points should be selected so that these pairs map as wide an area as possible. One approach is to use pairs of contact points about 72 mm apart axially, to map a 360 mm wide core in five pairs; optionally the innermost non-metallic core can be checked in four longitudinal quadrants (0, 90, 180, 270 degrees), or more or less depending on the innermost non-metallic core material condition.

Annular ITM Core Inner Surface Roughness Measurement:

The surface roughness of the innermost non-metallic core inner surface used in a Nexpress digital production press is an important factor for mounting and proper imaging performance of the annular ITM. In order to measure the innermost non-metallic core inner roughness, it is required to use a fixture holding it, as well as necessary surface roughness measurement equipment. Once the proper measurements are made, they can be used to assess whether an annular ITM will mount and meets the performance requirements.

A fixture to measure annular ITM innermost non-metallic core roughness includes the following:

1. Annular ITM support plate
2. Roughness measurement system (for example, using a Federal Surfanalyzer® 5000)
   a. Drive unit
   b. Probe
   c. Stylus
   d. Data Collection unit
   e. Computer
   f. Monitor Surface roughness measurements were made on the inside of innermost non-metallic cores made of both nickel and composite materials, which all showed adequately low roughness to allow mount ability on a cylindrical mandrel. The roughness measurement conditions used were:

1. Probe (50 mg force)
2. Stylus (2 μm radius diamond tip), non-skidded
3. Evaluation length (6 mm)
4. Traverse speed (2.5 mm/sec)
5. Filtration (ANSI 2-RC)
6. Cutoffs for roughness, waviness (0.8 mm)
7. Probe range+/−50 μm The results for annular ITM's, one having a nickel innermost core and two examples of the present invention, (one cast on a rough surface and one a smooth surface), in terms of various roughness characterization parameters calculated are shown in TABLE I below:

TABLE I

| Core Material | Roughness Parameters | | | | | | | |
|---|---|---|---|---|---|---|---|---|
| | Surface-Roughness Parameters (μm) | | | | | | | |
| | Roughness-type | | | | Profile-type | | | |
| Type | Ra | Ramx | Ramn | Rz | PRa | PRp | PRv | PRz |
| Nickel core | 0.14 | 0.21 | 0.10 | 0.94 | 0.22 | 0.70 | 0.85 | 1.19 |
| Innermost non-metallic core cast on rough surface | 0.99 | 1.33 | 0.73 | 5.98 | 1.64 | 7.00 | 5.40 | 8.87 |
| Innermost non-metallic core cast on smooth surface | 0.67-0.89 | 1.07-1.46 | 0.39-0.50 | 4.21-4.51 | 1.02-1.10 | 4.90-5.30 | 4.10-12.85 | 6.06-7.80 |

The present invention provides at least the following embodiments and combinations thereof, but other combinations of features are considered to be within the present invention as a skilled artisan would appreciate from the teaching of this disclosure:

1. An annular intermediate transfer member for transfer of toner particles, the annular intermediate transfer member comprising:

an innermost non-metallic core, a cushioning layer, and an outermost toner-carrying layer, wherein the innermost non-metallic core has all of the following properties:

1) a mounting force of equal to or less than 15 $lb_f$, 2) a radial resistance of up to and including 50,000 ohms of the innermost non-metallic core thickness, and 3) a surface resistance of up to and including 17,000 ohm.

2. The annular intermediate transfer member of embodiment 1, wherein the innermost non-metallic core comprises one or more resin binders, at least one of which is an unsaturated polyester.

3. The annular intermediate transfer member of embodiment 1 or 2, wherein the innermost non-metallic core comprises a homogeneous blend of two or more resin binders, at least one of which is an unsaturated polymer.

4. The annular intermediate transfer member of any of embodiments 1 to 3, wherein the innermost non-metallic core comprises a uniform blend of one or more resin binders and a reinforcing material selected from the group consisting of glass fibers, inorganic fillers, polymeric fillers, polymeric fibers, and mixtures thereof.

5. The annular intermediate transfer member of any of embodiments 1 to 4, wherein the innermost non-metallic core comprises a uniform blend of one or more resin binders and at least one conductive material selected from the group consisting of conductive polymers, conductive inorganic fillers, carbon/graphic fillers, conductive metal particles, conductive bonding agents on glass fibers, and mixtures thereof 6. The annular intermediate transfer member of any of embodiments 1 to 5 that has a rigid structure.

7. The annular intermediate transfer member of any of embodiments 1 to 6 that has a flexible structure sufficient to reduce the smallest diameter to as little as 20% of the diameter of the annular intermediate transfer member when it is in a non-flexed state.

8. The annular intermediate transfer member of any of embodiments 1 to 7, wherein the innermost non-metallic core has an average dry thickness of at least 0.1 mm and up to and including 3 mm.

9. The annular intermediate transfer member of any of embodiments 1 to 8, wherein the innermost non-metallic core has an average dry thickness of at least 0.3 mm and up to and including 5 mm.

10. The annular intermediate transfer member of any of embodiments 1 to 9 that has an average dry thickness of at least 0.4 mm and up to and including 1.7 mm.

11. The annular intermediate transfer member of any of embodiment 1 to 10, wherein the non-metallic core is directly adhered to the cushioning layer or it is adhered with an intermediate subbing or primer layer.

12. The annular intermediate transfer member of any of embodiments 1 to 11 that has a seamless outer surface.

13. The annular intermediate transfer member of any of embodiments 1 to 12, wherein the innermost non-metallic core has elasticity so that, when a pressurized fluid is forced along the inner surface of the innermost non-metallic core, the innermost non-metallic core can be moved relative to a rigid cylindrical member that it surrounds, which rigid cylindrical member has an outer diameter that is greater than the inner diameter of the innermost non-metallic core such that the innermost non-metallic core cannot be moved relative to the rigid cylindrical member without the pressurized fluid.

14. An apparatus for forming toner images, the apparatus comprising:

1) at least one image-forming device for forming a toner image on a toner receiving element, 2) a transfer system for transferring the toner image from the receiving member to the annular intermediate transfer member of any of embodiments 1 to 13, to form an image on the outermost toner-carrying layer of the annular intermediate transfer member, and 3) a second transfer system for transferring the image formed on the toner-carrying layer of the annular intermediate transfer member onto an image receiving material.

15. The apparatus of embodiment 14, wherein the toner receiving element is a photoconductor.

16. A method for providing a toned image on an image receiving member, the method comprising:

forming a toner image corresponding to a predetermined image on a toner receiving element, transferring the toner image from the toner receiving element to the outermost toner-carrying layer of the annular intermediate transfer member of any of embodiments 1 to 13, and transferring the toner image from the toner-carrying layer of the annular intermediate transfer member onto an image receiving material.

17. The method of embodiment 16 for forming a color image by sequentially forming color toner images on the toner receiving element and sequentially transferring the color toner images from the toner receiving element to two or more annular intermediate transfer members, and then transferring the sequential color toner images from the two or more annular intermediate transfer members to an image receiving material in superimposed registration.

The present invention has been described in detail with particular reference to certain preferred embodiments thereof, but it will be understood that variations and modifications can be effected within the spirit and scope of the invention.

The invention claimed is:

1. An annular intermediate transfer member for transfer of toner particles, the annular intermediate transfer member comprising:

an innermost non-metallic core, a cushioning layer, and an outermost toner-carrying layer, wherein the innermost non-metallic core has all of the following properties:

1) a mounting force of equal to or less than 15 $lb_f$, 2) a radial resistance of up to and including 50,000 ohms of the innermost non-metallic core thickness, and 3) a surface resistance of up to and including 17,000 ohm.

2. The annular intermediate transfer member of claim 1, wherein the innermost non-metallic core comprises one or more resin binders, at least one of which is an unsaturated polyester.

3. The annular intermediate transfer member of claim 1, wherein the innermost non-metallic core comprises a homogeneous blend of two or more resin binders, at least one of which is an unsaturated polymer.

4. The annular intermediate transfer member of claim 1, wherein the innermost non-metallic core comprises a uniform blend of one or more resin binders and a reinforcing material selected from the group consisting of glass fibers, inorganic fillers, polymeric fillers, polymeric fibers, and mixtures thereof.

5. The annular intermediate transfer member of claim 1, wherein the innermost non-metallic core comprises a uniform blend of one or more resin binders and at least one conductive material selected from the group consisting of conductive polymers, conductive inorganic fillers, carbon/graphic fillers, conductive metal particles, conductive bonding agents on glass fibers, and mixtures thereof.

6. The annular intermediate transfer member of claim 1 that has a rigid structure.

7. The annular intermediate transfer member of claim 1 that has a flexible structure sufficient to reduce the smallest diameter to as little as 20% of the diameter of the annular intermediate transfer member when it is in a non-flexed state.

8. The annular intermediate transfer member of claim 1, wherein the innermost non-metallic core has an average dry thickness of at least 0.1 mm and up to and including 3 mm.

9. The annular intermediate transfer member of claim 1, wherein the innermost non-metallic core has an average dry thickness of at least 0.3 mm and up to and including 2 mm.

10. The annular intermediate transfer member of claim 1 that has an average dry thickness of at least 0.4 mm and up to and including 5 mm.

11. The annular intermediate transfer member of claim 1, wherein the non-metallic core is directly adhered to the cushioning layer or it is adhered with an intermediate subbing or primer layer.

12. The annular intermediate transfer member of claim 1 that has a seamless outer surface.

13. The annular intermediate transfer member of claim 1, wherein the innermost non-metallic core has elasticity so that, when a pressurized fluid is forced along the inner surface of the innermost non-metallic core, the innermost non-metallic core can be moved relative to a rigid cylindrical member that it surrounds, which rigid cylindrical member has an outer diameter that is greater than the inner diameter of the innermost non-metallic core such that the innermost non-metallic core cannot be moved relative to the rigid cylindrical member without the pressurized fluid.

14. An apparatus for forming toner images, the apparatus comprising:

1) at least one image-forming device for forming a toner image on a toner receiving element, 2) a transfer system for transferring the toner image from the receiving member to the annular intermediate transfer member of claim 1, to form an image on the outermost toner-carrying layer of the annular intermediate transfer member, and 3) a second transfer system for transferring the image formed on the toner-carrying layer of the annular intermediate transfer member onto an image receiving material.

15. The apparatus of claim 14, wherein the toner receiving element is a photoconductor.

16. The apparatus of claim 14, wherein the innermost non-metallic core of the annular intermediate transfer member has elasticity so that, when a pressurized fluid is forced along the inner surface of the innermost non-metallic core, the innermost non-metallic core can be moved relative to a rigid cylindrical member that it surrounds, which rigid cylindrical member has an outer diameter that is greater than the inner diameter of the innermost non-metallic core such that the innermost non-metallic core cannot be moved relative to the rigid cylindrical member without the pressurized fluid.

17. A method for providing a toned image on an image receiving member, the method comprising:

forming a toner image corresponding to a predetermined image on a toner receiving element, transferring the toner image from the toner receiving element to the outermost toner-carrying layer of the annular intermediate transfer member of claim 1, and transferring the toner image from the toner-carrying layer of the annular intermediate transfer member onto an image receiving material.

18. The method of claim 17, wherein the toner receiving element is a photoconductor.

19. The method of claim 17 for forming a color image by sequentially forming color toner images on the toner receiving element and sequentially transferring the color toner images from the toner receiving element to two or more annular intermediate transfer members, and then transferring the sequential color toner images from the two or more annular intermediate transfer members to an image receiving material in superimposed registration.

20. The method of claim 17, wherein:

the innermost non-metallic core comprises: (1) a homogeneous blend of two or more resin binders, at least one of which is an unsaturated polyester, (s) a uniform blend of one or more resin binders and a reinforcing material selected from the group consisting of glass fibers, inorganic fillers, polymeric fillers, polymeric fibers, and mixtures thereof, and (3) a uniform blend of one or more resin binders and at least one conductive material selected from the group consisting of conductive polymers, conductive inorganic fillers, carbon/graphic fillers, conductive metal particles, conductive bonding agents on glass fibers, and mixtures thereof, the innermost non-metallic core has an average dry thickness of at least 0.1 mm and up to and including 3 mm, the innermost non-metallic core has elasticity so that, when a pressurized fluid is forced along the inner surface of the innermost non-metallic core, the innermost non-metallic core can be moved relative to a rigid cylindrical member that it surrounds, which rigid cylindrical member has an outer diameter that is greater than the inner diameter of the innermost non-metallic core such that the innermost non-metallic core cannot be moved relative to the rigid cylindrical member without the pressurized fluid, and the annular intermediate transfer member has an average dry thickness of at least 0.3 mm and up to and including 4 mm.

* * * * *